US005088734A

United States Patent [19]

Glava

[11] Patent Number: 5,088,734

[45] Date of Patent: Feb. 18, 1992

[54] ATTENUATING HANDLE FOR RECREATIONAL AND WORK IMPLEMENTS

[76] Inventor: Gary L. Glava, 6025 E. Donna Cir., Paradise Valley, Ariz. 85253

[21] Appl. No.: 639,240

[22] Filed: Jan. 9, 1991

Related U.S. Application Data

[63] Continuation-in-part of Ser. No. 550,791, Jul. 9, 1990, abandoned, which is a continuation of Ser. No. 133,923, Dec. 16, 1987, abandoned.

[51] Int. Cl.[5] ..... A63B 49/08

[52] U.S. Cl. ..... 273/73 J; 273/81 R; 273/72 R; 273/DIG. 29

[58] Field of Search ..... 273/73 J, 73 R, 75, 273/81 R, 72 R, 67 A, 80.8, 80 A, 80 R, 80 B, DIG. 29

[56] References Cited

U.S. PATENT DOCUMENTS

| | | | |
|---|---|---|---|
| 2,000,295 | 5/1935 | Oldham | 273/81 |
| 2,541,851 | 8/1946 | Wright | 260/37 |
| 2,884,969 | 5/1959 | Lay | 145/29 |
| 3,020,260 | 2/1962 | Nelson | 260/465 |
| 3,350,344 | 10/1967 | Beers | 260/37 |
| 3,547,440 | 12/1970 | Deer | 273/73 |
| 3,548,420 | 12/1970 | Spence | 3/20 |
| 3,607,601 | 8/1971 | Milam | 161/159 |
| 3,661,790 | 5/1972 | Dean | 252/301.3 R |
| 3,762,707 | 10/1973 | Santorelli | 273/80 B |
| 3,770,033 | 11/1973 | Gavillet | 145/61 C |
| 3,941,380 | 3/1976 | Lacoste | 273/72 A |
| 3,998,215 | 12/1976 | Anderson | 128/206 E |
| 4,082,273 | 4/1978 | Ellzey | 273/73 J |
| 4,105,205 | 8/1978 | Theodores | 273/73 J |
| 4,347,280 | 8/1982 | Lau | 428/304.4 |
| 4,369,284 | 1/1983 | Chen | 524/476 |
| 4,373,718 | 2/1983 | Schmidt | 273/75 |
| 4,380,569 | 4/1983 | Shaw | 428/283 |
| 4,595,635 | 6/1986 | Dubrow | 428/447 |
| 4,600,261 | 7/1986 | Debbaut | 339/116 C |
| 4,634,207 | 1/1987 | Debbaut | 339/116 C |
| 4,660,832 | 4/1987 | Shomo | 273/73 J |
| 4,690,831 | 9/1987 | Uken | 427/44 |

FOREIGN PATENT DOCUMENTS

| | | |
|---|---|---|
| 2106800 | 9/1971 | Fed. Rep. of Germany . |
| 3201863 | 8/1983 | Fed. Rep. of Germany . |
| 3428528 | 2/1986 | Fed. Rep. of Germany . |
| 19150 | 8/1907 | United Kingdom . |
| 170717 | 8/1920 | United Kingdom . |
| 498430 | 1/1938 | United Kingdom . |
| 2133026 | 7/1984 | United Kingdom . |
| 2149311 | 6/1985 | United Kingdom . |

OTHER PUBLICATIONS

Raychem Corporation Brochure, "Geltek Systems 1000 Strip", 1985 (8/86).

*Primary Examiner*—Edward M. Coven
*Assistant Examiner*—William E. Stoll
*Attorney, Agent, or Firm*—Burns, Doane, Swecker & Mathis

[57] ABSTRACT

A hand-operated implement, which is a shock-producing or vibration-producing implement, having an attenuating handle. The implement has a handle attached to the implement, which handle has a central core, a gripping surface and a gel shock- or vibration-absorbing material positioned adjacent to or recessed in the core and under the gripping surface, wherein the gel shock- or vibration-absorbing material is a gel having a cone penetration between about 100 and 350($10^{-1}$ mm) and a ultimate elongation of at least 100% and wherein the thickness of the gel shock- or vibration-absorbing material is sufficient to substantially maintain a shock- or vibration-absorbing separation between the core and at least a portion of the gripping surface, provided that the thickness of the gel shock- or vibration-absorbing material is less than that which interfers with the use of control of the implement, thereby absorbing the shock or vibration produced by the implement without significantly changing the operating control characteristics of the implement. Also disclosed is a method of attenuating shock and vibration in a handle of an implement.

31 Claims, 2 Drawing Sheets

ATTENUATING HANDLE FOR RECREATIONAL AND WORK IMPLEMENTS

RELATED APPLICATIONS

This application is a continuation-in-part of Ser. No. 07/550,791 filed July 9, 1990, now abandoned, which is a continuation of Ser. No. 07/133,923 filed Dec. 16, 1987, now abandoned.

FIELD OF THE INVENTION

This invention relates to the field of recreational and work implements such as tennis rackets, hammers, and the like. More particularly, this invention relates to such implements having an improved attenuating handle useful for absorbing or lessening shocks and vibrations.

BACKGROUND OF THE INVENTION

Various schemes have been proposed for lessening the effect of shock and vibration in implements. Some of these schemes use a material inside the handle of the implement, which material serves to dampen or attenuate the effect of the shocks and vibrations. For example, Lacoste, U.S. Pat. No. 3,941,380 and Theodores et al., U.S. Pat. No. 4,105,205 have proposed handles containing a silicone fluid, while U.K. Patent No. 498,430 has proposed filling the handle with a pasty material consisting of glycerine and a powder. U.K. Patent Application No. 2,149,311 has proposed inserting wedge-shaped rubber damping material in the handle.

It has been found, however, that the most effective attenuation occurs if the attenuating material is on the outside of the handle.

The art is replete with references which add material to the handle to improve its attenuating character and/or its grip. Among these references are Gavillet et al., U.S. Pat. No. 3,770,033 (handle of foam over a rigid core), Deer, U.S. Pat. No. 3,547,440 (plastic handle), Lay, U.S. Pat. No. 2,884,969 (hammer with elastomeric or plastic covering), Oldham, U.S. Pat. No. 2,000,295 (improved grip), U.K. Patent Specifications 170,717 and 19,150 (handle having axial strips of damping material), German DE 2106800 (handle having damping material), German DE 3428528 (vibration reducing handle), and German DE 3201863 (improved grip).

Lau et al., U.S. Pat. No. 4,347,280 and Milam et al., U.S. Pat. No. 3,607,601 suggest laminate materials for improving the capability of structures to absorb shocks and vibrations.

Notwithstanding the multiplicity of materials and structure proposed by those in the art, there still remains a need for an implement having an improved handle for absorbing shocks and vibrations.

Accordingly, it is an object of the invention to have an improved handle for an implement wherein the handle has an improved capability for absorbing shocks and vibrations.

It is another object of the invention to have an implement having such improved handle for absorbing shocks and vibrations.

It is yet another object of the invention to have an implement having an improved handle for absorbing shocks and vibrations wherein the grip of the handle and the control and use of the implement are not adversely effected.

These and other objects of the invention will become more apparent after referring to the following description considered in conjunction with the accompanying drawings.

BRIEF SUMMARY OF THE INVENTION

The objects of the invention have been achieved by providing an implement having a particular attenuating handle. The implement comprises a working portion and a handle communicating with the working portion. The handle has a central core and a shock- or vibration-absorbing material adjacent to the core, wherein the shock- or vibration-absorbing material comprises a gel having a cone penetration between about 100 and 350 ($10^{-1}$ mm) and an ultimate elongation of at least about 100%.

According to one aspect of the invention, there is disclosed a hand-operated implement, which is a shock-producing or vibration-producing implement, comprising a handle attached to the implement, the handle having a central core, a gripping surface, and a gel shock- or vibration-absorbing material positioned between the core and the gripping surface, wherein the gel shock-or vibration-absorbing material comprises a gel having a cone penetration between about 100 and 350($10^{-1}$ mm) and an ultimate elongation of at least about 100% and wherein the thickness of the gel shock- or vibration-absorbing material is sufficient to substantially maintain a shock- or vibration-absorbing separation between the core and at least a portion of the gripping surface, provided that the thickness of the gel shock- or vibration-absorbing material is less than that which interferes with the use or control of the implement, thereby absorbing the shock or vibration produced by the implement without significantly changing the operating control characteristics of the implement.

According to another aspect of the invention, there is disclosed an attenuating handle for a hand-operated implement, which is a shock-producing or vibration-producing implement, comprising a central core, means for attaching the core to the implement, a gripping surface, and a gel shock- or vibration-absorbing material positioned between the core and the gripping absorbing material comprises a gel having a cone penetration between about 100 and 350($10^{-1}$ mm) and an ultimate elongation of at least 100% and wherein the thickness of the gel shock- or vibration-absorbing material is sufficient to substantially maintain a shock- or vibration-absorbing separation between the core and at least a portion of the gripping surface, provided that the thickness of the gel shock- or vibration-absorbing material is less than that which interferes with the use or control of the implement, thereby absorbing the shock or vibration produced by the implement without significantly changing the operating control characteristics of the implement.

It is a preferred embodiment that the gel shock- or vibration-absorbing material be adjacent to the core of the handle.

Yet another aspect of the invention relates to a method of attenuating shock and vibration in a handle of a hand-operated implement, which is a shock-producing or vibration-producing implement, comprising the step of placing a gel shock- or vibration-absorbing material on the handle of an implement, wherein the gel shock- or vibration-absorbing material comprises a gel having a cone penetration between about 100 and 350($10^{-1}$ mm) and an ultimate elongation of at least about 100% and wherein the thickness of the gel shock- or vibration-absorbing material is sufficient to substantially maintain a shock- or vibration-absorbing separation between the core and at least a portion of the gripping surface, provided that the thickness of the gel shock- or vibration-absorbing material is less than that which interferes with the use or control of the implement, thereby absorbing the shock or vibration produced by the implement without significantly changing the operating control characteristics of the implement.

DETAILED DESCRIPTION OF THE INVENTION

Figure 2:
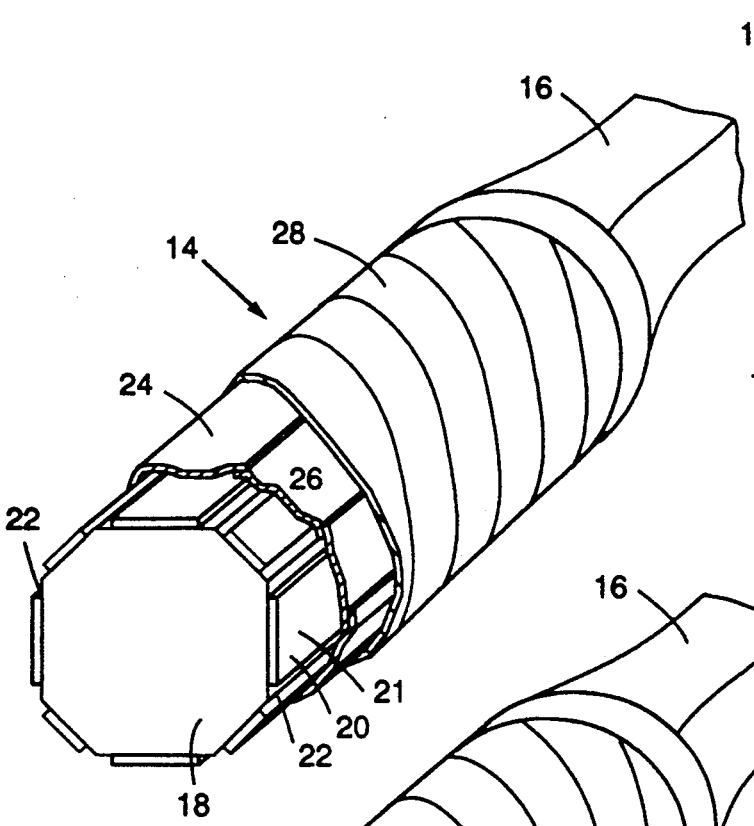
FIG. 2 is an enlarged breakaway perspective view of the handle of the implement in FIG. 1 showing the construction of the handle.
Figure 1:
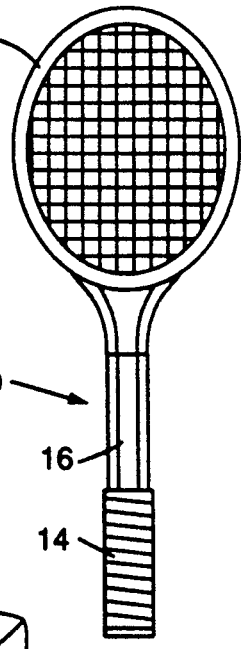
FIG. 1 is a top view of an implement according to the invention.

Referring to the Figures, and particularly referring to FIGS. 1 and 2, there is shown a preferred embodiment of the invention, which for purposes of illustration is a tennis racket. The following discussion will describe the invention in detail with respect to the embodiment of the tennis racket, but it should be understood, however, that the invention applies to many implements besides tennis rackets, and thus, the invention should not be limited to any particular implement.

The tennis racket, generally indicated by 10, comprises a working portion 12 and a handle, generally indicated by 14. The working portion 12 in communication with handle 14 by shaft 16. The working portion 12 of the implement is that portion that contacts the work piece, thereby generating the shocks and vibrations. In FIG. 1, the working portion 12 is the stringed part of the tennis racket which makes contact with the tennis ball. Upon contact, shock waves and vibrations are sent through the entire tennis racket via shaft 16. According to the invention, however, these shock waves and vibrations are substantially attenuated by the handle 14 of this invention.

The handle 14 comprises a central core 18 and a gel shock- or vibration-absorbing material 0 adjacent to or recessed in the core which serves to attenuate the incoming shock waves and vibrations. The gel shock- or vibration-absorbing material most preferably comprises a gel of any of the types described in Dubrow et al., U.S. Pat. No. 4,595,635, Debbaut, U.S. Pat. Nos. 4,600,261 and 4,634,207, Uken et al., U.S. Pat. No. 4,690,831, Chen, U.S. Pat. No. 4,369,284 and U.K. Patent Application No. 2,133,026, the disclosures of which are incorporated by reference herein. Preferably, as well, the gel should be a tape or sheet such as described in the Dubrow et al. patent. In the Dubrow et al. patent, the sheet or tape of gel is used for environmental or other protection of substrates. The gel materials useful in the present invention can comprise a urethane, silicone, or a non-silicone liquid preferably with low or no unsaturation which has been cross-linked to provide a gel having a cone penetration between about 100 and 350($10^{-1}$ mm) and an ultimate elongation of at least about 100%, as measured in accordance with American National Standard Designation ASTM-D217 and ASTM-D638, respectively. Preferably, the cone penetration is between about 125 and 325 ($10^{-1}$ mm), and more preferably between about 150 and 300($10^{-1}$ mm) Preferably the elongation is at least about 200% and more preferably at least about 500%.

Gels, having the above properties are used in the present invention because they have good shock-absorbing properties than cannot be obtained with, for example, elastomeric materials which are harder and less absorbing of the shock waves and vibrations, and they are easier to handle and contain in the desired shape and position than viscous damping fluids. Also, the shock- or vibration-absorbing properties of these gels may be varied by varying the hardness, i.e., cone penetration, of the gel. That is, one level of hardness (cone penetration) would be ideal for a light hitting player (in the case of a tennis racket), while another level of hardness (cone penetration) would be ideal for a heavy hitting player. Variation of the hardness of the gel is known in the art as illustrated by the Dubrow et al., Debbaut, and other patents cited above.

The gels used in this invention are very soft. A gel having a cone penetration between about 100 and about 350 ($10^{-1}$ mm) is much softer be as soft as about 50 to 80 ($10^{-1}$ mm), but are normally so much harder they are measured on a different hardness scale standard test. These gel materials have about the same softness, i.e., cone penetration, as a grease or petroleum jelly, but do not behave as a grease because of the high elongation properties of the gel. Thus, elastomers and soft rubbers are too hard to absorb and dissipate shocks and vibration as effectively as the very soft gel materials. Greases, liquids and viscous fluids are ineffective in absorbing or dissipating shocks and vibrations in an implement handle, because they move and permanently deform, allowing them to be depleted in the areas needed. Thus, they are squeezed out of particular grip areas and do not return until squeezed back. Also, if a grease or liquid is used in large enough quantities and is contained in the handle so it can not be squeezed out of place, the handle will be too soft and flexible and control of the implement will be impaired or diminished or else the grease or liquid will be under such pressure that they become ineffective in absorbing or dissipating shocks or vibrations.

It is the unique combination of properties of the extreme softness, cone penetration 100 to 350 ($10^{-1}$ mm), and the high elongation, at least 100%, that enables the gels of this invention to effectively absorb and dissipate shocks or vibrations in very thin layers or sections. This combination enables the softness of the gel to absorb and dissipate shocks and vibrations by dispersing the energy by deforming the gel, while at the same time, the high elongation of the gel provides the resilience to recover the gel to its original shape without permanent deformation. The gel thereby simultaneously absorbs, dissipates and disperses the shock/vibration energy and retains its original shape to provide unimpaired use and control of the implement.

The thickness of the gel shock- or vibration-absorbing material to be used between the core and the gripping surface will be apparent to one skilled in the art following the disclosure and examples herein. In principle, as illustrated in the drawings, the gel material should be thick enough to substantially maintain a shock- or vibration-absorbing separation between the core and at least a substantial portion of the gripping surface under the conditions of implement use. If the gel layer is too thin for the use involved it will not be fully effective. If the gel layer is too thick, i.e., thicker than the minimum needed for the shock- or vibration-absorbing, then the control and feel of the implement may be adversely affected. If the gel material is used in a proper thickness, it will not interfere with the use or control of the implement, but will still be quite effective in absorbing shocks and vibrations. It has been found quite surprising that a layer of the very soft gel material does not interfere with the use, control, or accuracy or changing the operating characteristics of the implement, and equally surprising that such a thin layer of the gel material can be so effective in absorbing shocks and vibration.

As shown in FIG. 2, it is preferred that the gel 20 comprises strips of material which are spaced apart as indicated by 22. It is further preferred that the strips of gel 20 are positioned generally parallel to the axis of the handle 14 as shown in FIG. 2.

The implement 10 further comprises an intermediate layer of material 24 positioned over the shock- or vibration-absorbing gel 20. The intermediate layer of material 24 may be a polymeric material such as MYLAR ® (a product of E. I. DuPont de Nemours). The intermediate layer of material 24 preferably comprises overlapping strips of material as shown in FIG. 2. Most preferably, the overlapping strips of material 24 are positioned generally parallel to the axis of the handle.

It has been found that the structure of the handle as shown in FIG. 2 is most preferred because it allows for the attenuation of shocks and vibrations without otherwise increasing the grip size to dramatically.

The gel may be formulated so as to have a tacky surface. It is preferred that the gel have at least one tacky surface so that the gel may be more expeditiously positioned on the surface of the central core 18. It is not necessary for the surface 21 of the gel facing away from the central core 18 to be tacky, as the intermediate layer of material 24 may comprise an adhesive 26 so that the intermediate layer of material will adhere to the shock- or vibration-absorbing gel 20. Of course, the surface 21 of the gel facing away from the central core 18 may be tacky, in which case the adhesive 26 on the intermediate layer of material 24 may be dispensed with, if desired. In any event, the surface tack of the gel may be varied or eliminated, as desired, as taught by the Dubrow et al. patent.

Finally, the handle 14 further comprises a top layer of material 28 wrapped around the intermediate layer of material 24 as shown in FIG. 2. In practice, this top layer of material 28 which provides the gripping surface will usually be leather so as to impart a desirable feel to the handle.

While it is generally preferred that the gel be positioned on the core, it should be noted that the gel materials may be positioned between layers of other materials in the handle so long as the gel is positioned between the core and the gripping surface of the handle.

As alluded to earlier, the hand-operated implement of this invention may take many forms. One particularly preferred embodiment is the tennis racket already discussed wherein the handle is specially structured to attenuate shocks and vibrations. In general, the invention applies to many recreational implements where it might be desirable to have a handle which attenuates shocks and vibrations. Among those recreational implements are, for purposes of illustration and not of limitation, golf clubs, racquet-ball rackets, baseball bats, bicycle handle-bars, ski poles, and the like.

The invention also has broad applicability to hand-operated construction tools and garden tools which are shock-producing or vibration-producing implements. Again, for purposes of illustration and not of limitation, the construction and garden tools may be hammers, jack-hammers, axes, hedge clippers, and the like.

Figure 3:
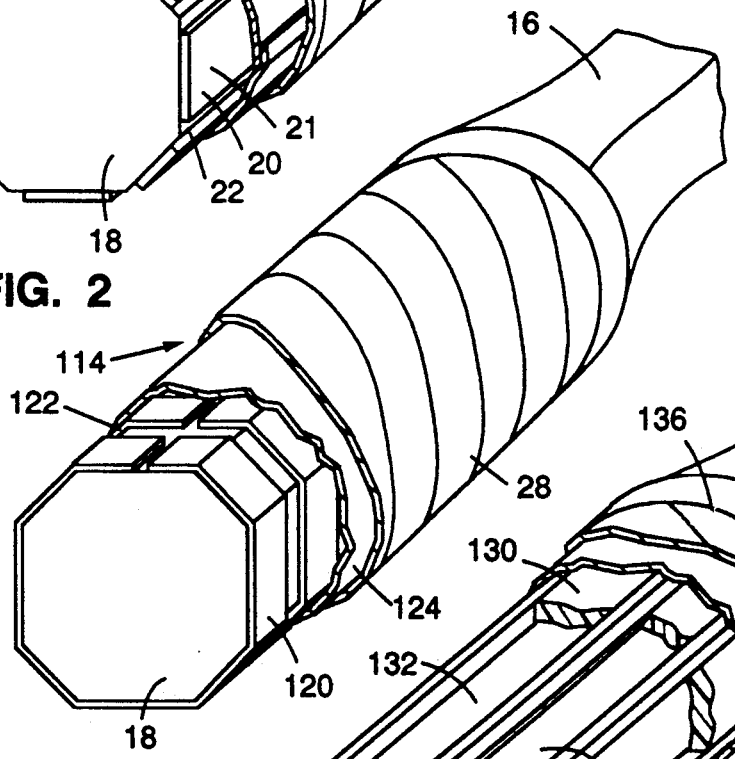
FIG. 3 is an enlarged breakaway perspective view of the handle of the implement in FIG. 1 showing an alternative construction of the handle.

An alternative embodiment of the invention is illustrated in FIG. 3. In this embodiment, the shock- or vibration-absorbing strips of gel material 120 are wrapped around the central core 18. It is desirable to leave spaces 122 between the strips of gel as was the case with the embodiment in FIG. 2. The intermediate layer of material 124 is then wrapped around the shock- or vibration-absorbing gel 120. Preferably, the intermediate layer of material 124 will overlap adjacent strips of gel. Finally, top layer 128 providing the gripping surface is wrapped around the intermediate layer of material 124 as before.

While not shown in FIG. 3, the shock- or vibration-absorbing gel 120 or the intermediate layer of material 124, or both, may be spirally wrapped around the central core 18. This particular construction will produce an attenuating handle according to the invention; however, the grip size will be increased more than in the previously-described embodiments, and thus is not as preferred.

Figure 4:
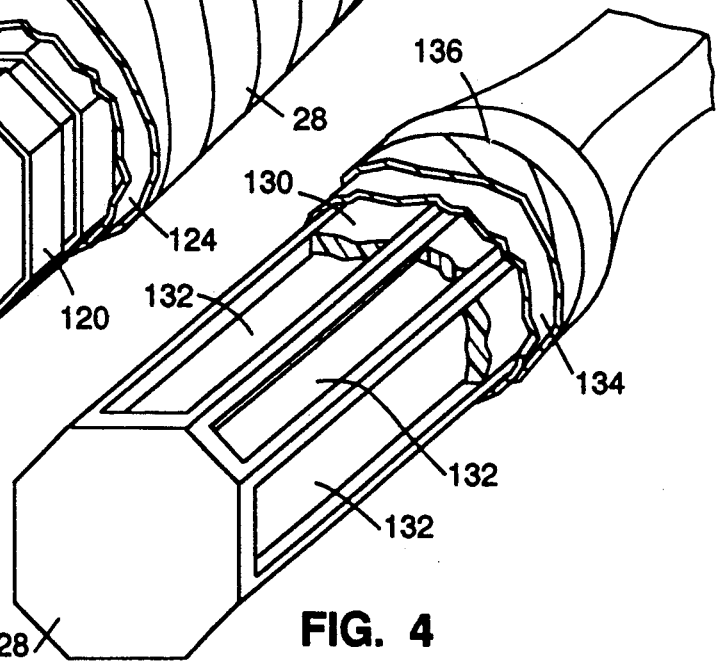
FIG. 4 is an enlarged breakaway perspective of view of the handle of the implement in FIG. 1 showing another alternative construction of the handle.
Figure 5:
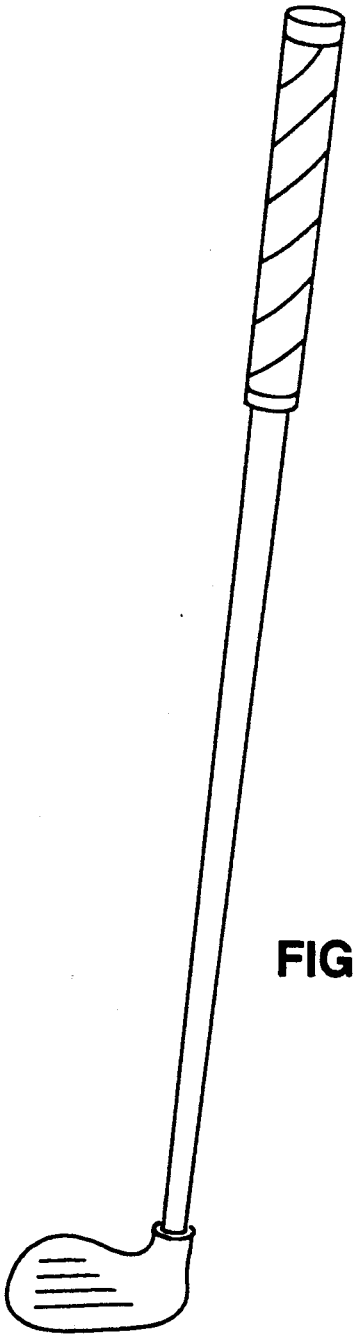
Figure 6:
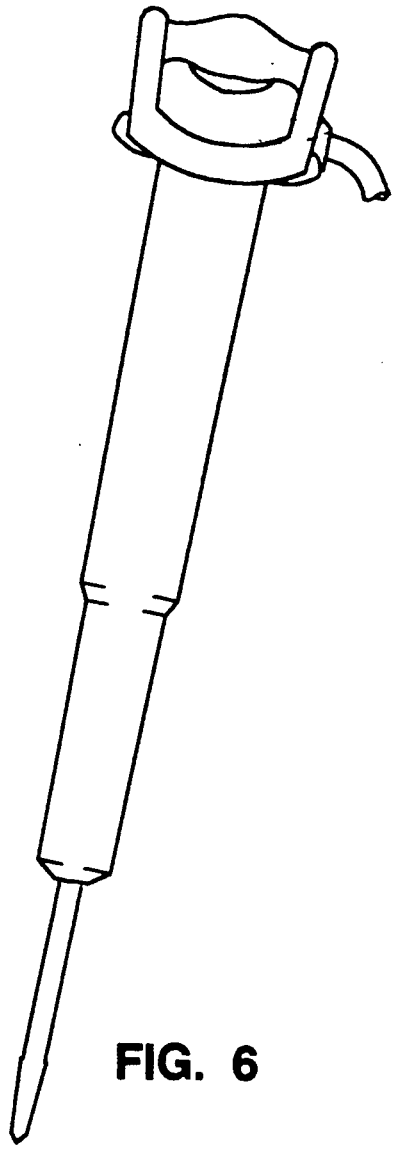
Figure 7:
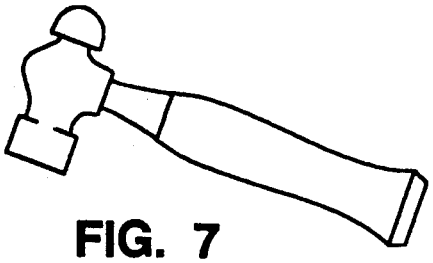
Figure 8:
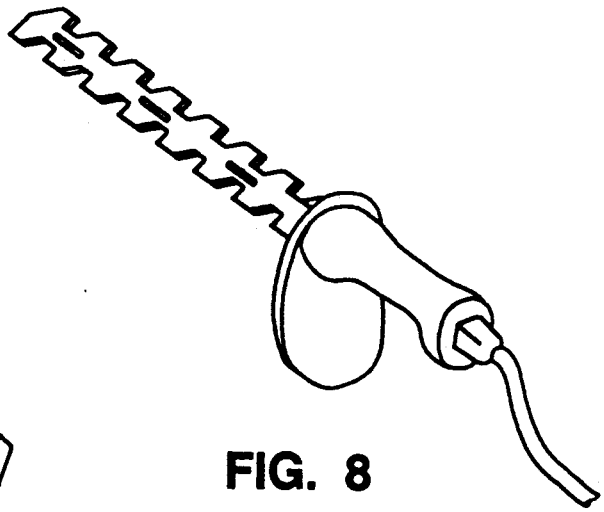

Another alternative embodiment of the invention is illustrated in FIG. 4. In this embodiment, the shock- or vibration-absorbing strips of material 130 are partially recessed into the central core 129 in recesses 132, a portion of the material 130 extending above the outer surface of the core 128. This is accomplished by making the material 130 thicker, e.g., 30 mil., than the depth of the recesses, e.g., 20 mil. The material 130 is wrapped with an intermediate layer 134 and in turn with a top layer 136 as in the above-described embodiments.

A final aspect of the invention relates to a method of attenuating shock and vibration in a handle of an implement by placing a gel shock- or vibration-absorbing material on the handle of the implement, wherein the shock- or vibration-absorbing material comprises a gel having a cone penetration between about 100 and 350($10^{-1}$ mm) and an ultimate elongation of at least about 100%.

The gel which is preferred for use with this aspect of the invention may be any of the gels mentioned above.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

What is claimed is:

1. A hand-operated implement, which is a shock-producing or vibration-producing implement, comprising:

a handle attached to the implement, the handle having:

a central core;

a flexible outer gripping surface; and a gel shock- or vibration-absorbing material positioned between the core and the flexible outer gripping surface thereby substantially encircling the core and whereby a depression in the flexible outer gripping surface is capable of causing a corresponding depression in the gel material, wherein the gel shock- or vibration-absorbing material comprises a gel having a cone penetration between about 100 and 350($10^{-1}$ mm) and an ultimate elongation of at least about 100% and wherein the thickness of the gel shock- or vibration-absorbing material is sufficient to substantially maintain a shock- or vibration-absorbing separation between the core and at least a portion of the gripping surface, provided that the thickness of the gel shock- or vibration-absorbing material is less than that which interferes with the use or control of the implement, thereby absorbing the shock or vibration produced by the implement without significantly changing the operating control characteristics of the implement.

2. The implement of claim 1 wherein the gel shock- or vibration-absorbing material is adjacent to the core.

3. The implement of claim 1 wherein the gel shock- or vibration-absorbing material is partially recessed into the core, a portion of said material extending above the outer surface of the core.

4. The implement of claim 1 wherein the gel shock- or vibration-absorbing material comprises spaced-apart strips of material.

5. The implement of claim 4 wherein the gel shock- or vibration-absorbing strips of material are positioned parallel to the axis of the handle.

6. The implement of claim 4 wherein the gel shock- or vibration-absorbing strips of material are wrapped around the core.

7. The implement of claim 1 wherein the handle further comprises an intermediate layer of material positioned between the gel shock- or vibration-absorbing material and the gripping surface.

8. The implement of claim 7 wherein the intermediate layer of material comprises overlapping strips of material

9. The implement of claim 8 wherein the overlapping strips of material are positioned parallel to the axis of the handle.

10. The implement of claim 7 wherein the intermediate layer of material is wrapped around the gel shock- or vibration-absorbing material.

11. The implement of claim 7 where in the intermediate layer of material comprises an adhesive so that the intermediate layer of material will adhere to the gel shock- or vibration-absorbing material.

12. The implement of claim 7 wherein the handle further comprises a top layer of material wrapped around the intermediate layer of materials.

13. The implement of claim 1 wherein the implement is a recreational implement.

14. The implement of claim 13 wherein the recreational implement is a tennis racket.

15. The implement of claim 13 wherein the recreational implement is a golf club.

16. The implement of claim 1 wherein the implement is a construction tool.

17. The implement of claim 16 wherein the construction tool is a hammer.

18. The implement of claim 1 wherein the implement is a garden tool.

19. An attenuating handle for a hand-operated implement, which is a shock-producing or vibration-producing implement, comprising:

a central core;

means for attaching the core to the implement;

a flexible outer gripping surface; and a gel shock- or vibration-absorbing material positioned between the core and the flexible outer gripping surface thereby substantially encircling the core and whereby a depression in the flexible outer gripping surface is capable of causing a corresponding depression in the gel material, wherein the gel shock- or vibration-absorbing material comprises a gel having a cone penetration between about 100 and 350($10^{-1}$ mm) and an ultimate elongation of at least 100% and wherein the thickness of the gel shock- or vibration-absorbing material is sufficient to substantially maintain a shock- or vibration-absorbing separation between the core and at least a portion of the gripping surface, provided that the thickness of the gel shock- or vibration-absorbing material is less than that which interferes with the use or control of the implement, thereby absorbing the shock or vibration produced by the implement without significantly changing the operating control characteristics of the implement.

20. The handle of claim 19 wherein the gel shock- or vibration-absorbing material is adjacent to the core.

21. The handle of claim 19 wherein the gel shock- or vibration-absorbing material is partially recessed into the core, a portion of said material extending above the outer surface of the core.

22. The handle of claim 19 wherein the gel shock- or vibration-absorbing material comprises spaced-apart strips of material.

23. The handle of claim 22 wherein the gel shock- or vibration-absorbing strips of material are positioned parallel to the axis of the handle.

24. The handle of claim 22 wherein the gel shock- or vibration-absorbing strips of material are wrapped around the core.

25. The handle of claim 19 further comprising of a flexible intermediate layer of material positioned between the gel shock- or vibration-absorbing material and the gripping surface.

26. The handle of claim 25 wherein the intermediate layer of material comprises overlapping strips of material.

27. The handle of claim 26 wherein the overlapping strips of material are positioned parallel to the axis of the handle.

28. The handle of claim 25 wherein the intermediate layer of material is wrapped around the gel shock- or vibration-absorbing material.

29. The handle of claim 25 wherein the intermediate layer of material comprises an adhesive so that the intermediate layer of material will adhere to the gel shock- or vibration-absorbing material.

30. The handle of claim 25 wherein the handle further comprises a top layer of material wrapped around the intermediate layer of material.

31. A method of attenuating shock and vibration in a handle of a hand-operated implement, which is a shock-producing or vibration-producing implement, comprising the step of:

placing a gel shock- or vibration-absorbing material between the core and flexible outer gripping surface of the handle of an implement, wherein the gel shock- or vibration-absorbing material comprises a gel having a cone penetration between about 100 and 350($10^{-1}$ mm) and an ultimate elongation of at least about 100% and wherein the thickness of the gel shock-or vibration-absorbing material is sufficient to substantially maintain a shock- or vibration-absorbing separation between the core and at least a substantial portion of the gripping surface whereby a depression in the flexible outer gripping surface is capable of causing a corresponding depression in the gel material, provided that the thickness of the gel shock- or vibration-absorbing material is less than that which interferes with the use or control of the implement, thereby absorbing the shock or vibration produced by the implement without significantly changing the operating control characteristics of the implement.

* * * * *

UNITED STATES PATENT AND TRADEMARK OFFICE
CERTIFICATE OF CORRECTION

PATENT NO. : 5,088,734

DATED : February 18, 1992

INVENTOR(S) : Gary I. Glava

It is certified that error appears in the above-identified patent and that said Letters Patent is hereby corrected as shown below: On the title page, items [75] and [57] are as follows:

Inventor: delete "Gary L. Glava" and insert --Gary I. Glava-- therefor.

Abstract, line 16, delete "interfers" and insert --interferes-- therefor; delete "of" and insert --or-- therefor.

Column 2, line 41, following "gripping" insert -- surface, wherein the gel shock- or vibration- --.

Column 3, line 48, delete "0" and insert --20-- therefor.

Column 4, line 3, following "mm)" insert --.--, a period.

Column 4, line 24, following "softer" insert --than elastomers and rubber materials, which can--.

Column 7, line 3, delete "$10^{-'}$" and insert --$10^{-1}$-- therefor.

Column 8, line 36 and continuing on to line 37, delete "a flexible" and insert --an-- therefor.

Signed and Sealed this

Twentieth Day of July, 1993

*Attest:*

*Attesting Officer*

Michael K. Kirk

MICHAEL K. KIRK

*Acting Commissioner of Patents and Trademarks*